US008827664B2

(12) United States Patent
McCloud et al.

(10) Patent No.: US 8,827,664 B2
(45) Date of Patent: Sep. 9, 2014

(54) CEILING FAN MOTOR ADAPTER

(75) Inventors: Kareema A. McCloud, Cordova, TN (US); Brian H. Friedman, Collierville, TN (US)

(73) Assignee: Hunter Fan Company, Memphis, TN (US)

( * ) Notice: Subject to any disclaimer, the term of this patent is extended or adjusted under 35 U.S.C. 154(b) by 445 days.

(21) Appl. No.: 13/245,481

(22) Filed: Sep. 26, 2011

(65) Prior Publication Data

US 2013/0078108 A1 Mar. 28, 2013

(51) Int. Cl.

| | |
|---|---|
| ***F04D 25/06*** | (2006.01) |
| ***F04D 29/60*** | (2006.01) |
| ***F04D 25/08*** | (2006.01) |

(52) U.S. Cl.

CPC ..... *F04D 25/088* (2013.01); *F04D 25/0606* (2013.01)

USPC ..... 417/423.15; 417/360; 416/210 R; 403/109.6

(58) Field of Classification Search

USPC ..... 417/423.15, 424.1, 423.1, 360; 416/210 R; 403/109.6, 378, 403/379.1–379.6

See application file for complete search history.

(56) References Cited

U.S. PATENT DOCUMENTS

| | | | | | |
|---|---|---|---|---|---|
| 4,871,327 | A | * | 10/1989 | Ridgway et al. | 439/543 |
| 5,385,323 | A | * | 1/1995 | Garelick | 248/161 |
| 5,883,449 | A | * | 3/1999 | Mehta et al. | 310/60 R |
| 6,015,274 | A | | 1/2000 | Bias et al. | |
| 6,139,279 | A | | 10/2000 | Pearce et al. | |
| 6,234,757 | B1 | | 5/2001 | Pearce | |
| 6,357,714 | B1 | | 3/2002 | Johnson | |
| 6,382,917 | B1 | | 5/2002 | Zuege | |
| 7,066,721 | B2 | | 6/2006 | Bird | |
| 7,601,005 | B1 | | 10/2009 | Lai | |
| 7,621,498 | B2 | | 11/2009 | Tang | |
| 7,785,077 | B2 | | 8/2010 | Richardson et al. | |

* cited by examiner

*Primary Examiner* — Bryan Lettman

(74) *Attorney, Agent, or Firm* — Baker Donelson; Dorian B. Kennedy

(57) ABSTRACT

A ceiling fan motor (10) is disclosed which is coupled to a motor adapter (14) which in turn is coupled to a downrod (12) and motor housing (13). The motor adapter 14 has a downrod receiver (45), a motor shaft receiver (46), and three mounting arms (47). The downrod receiver is defined by a tubular cylindrical wall (52) which has a first set screw hole (58) and a threaded, second set screw hole (59) which are aligned with downrod set screw holes (60). The cylindrical wall includes ridges (61) which are positioned on either side of the second set screw hole (59). A threaded set screw (62) extends through the first set screw hole, through the downrod set screw holes, and threaded into the second set screw hole. The threaded set screw has a head (63) with a tapered portion (64) which abuts the downrod.

20 Claims, 6 Drawing Sheets

CEILING FAN MOTOR ADAPTER

TECHNICAL FIELD

This invention relates to ceiling fans and particularly to the motor adapter of a ceiling fan.

BACKGROUND OF THE INVENTION

Most ceiling fans are electrically powered. Typically they comprise an electric motor that is suspended beneath a ceiling by a hollow downrod through which electrical wires extend from building line power to the motor. An annular array of fan blades is coupled to the motor by means of blade irons.

Ceiling fans typically utilize a motor adapter to couple the motor to the downrod. The motor adapter is also coupled to the exterior, ornamental motor housing surrounding the motor. Some downrods are coupled to the motor adapter by having a mutually aligned passage extending through each component so that a locking pin extends through the passages to prevent relevant vertical movement therebetween. The problem with this design is that the weight of the ceiling fan rests upon the locking pin and as a result the ceiling fan may swing or wobble upon the locking pin.

Accordingly, it is seen that a need remains for a ceiling fan motor adapter that can efficiently couple the motor to the downrod without causing a wobbling of the ceiling fan during use. It is to the provision of such therefore that the present invention is primarily directed.

SUMMARY OF THE INVENTION

A ceiling fan comprises a motor having a motor shaft, a plurality of blades coupled to the motor, a downrod having a pair of downrod mounting holes, and a motor adapter coupled to the motor and the downrod. The motor adapter has a downrod receiver with a tubular wall having a first set screw hole therethrough aligned with the downrod pair of downrod mounting holes and a second set screw hole therethrough aligned with the downrod pair of downrod mounting holes. The second set screw hole has internal threads therein. The tubular wall has an interior surface with two projections extending therefrom. The second set screw hole is positioned between the two projections. The motor adapted also includes a set screw having a threaded shank configured to threadably mate with the threaded second set screw hole, a head, and a tapered portion. The tapered portion is tapered from a size smaller than the first set screw hole adjacent the shank to a size larger than the first set screw hole distal the shank.

DETAILED DESCRIPTION

Figure 1:
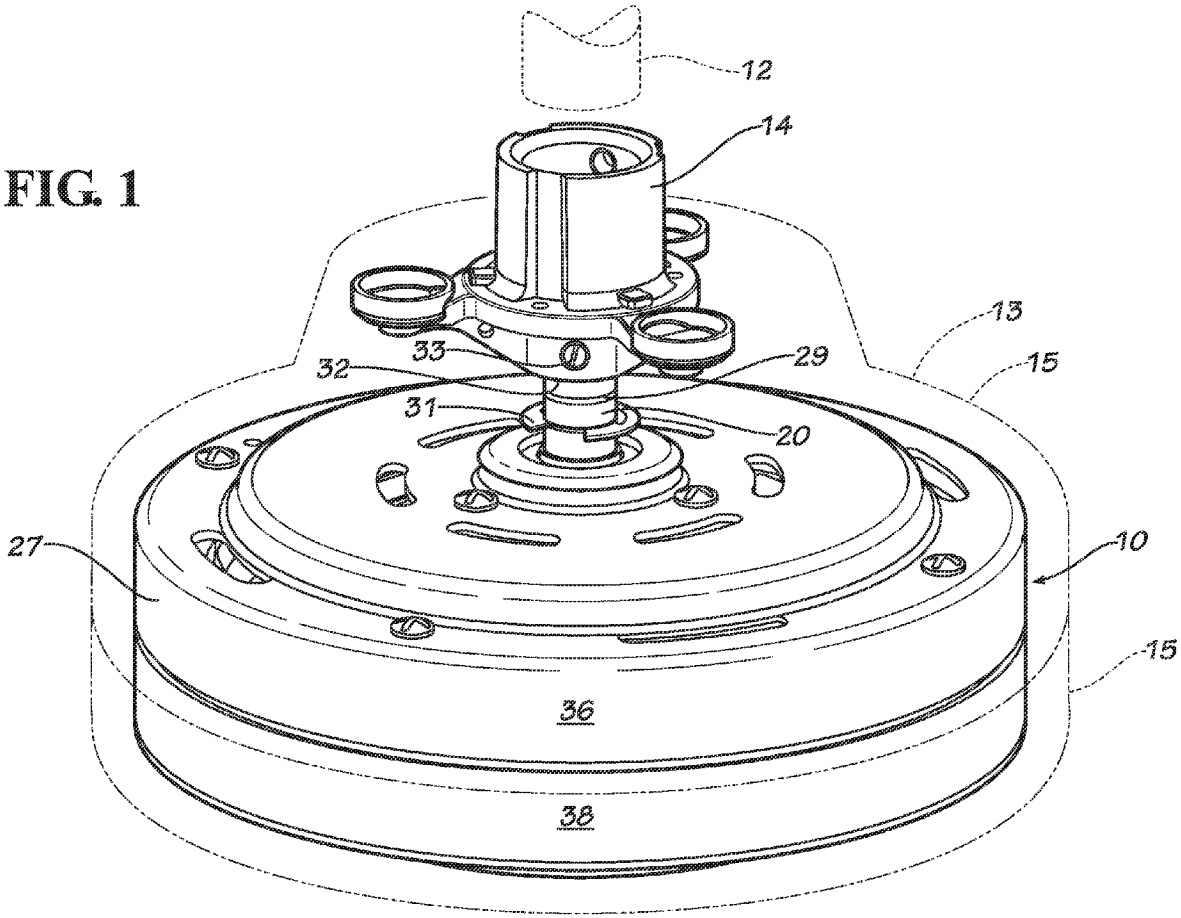
FIG. 1 is a perspective view of a portion of a ceiling fan embodying principles of the invention in a preferred form.
Figure 2:
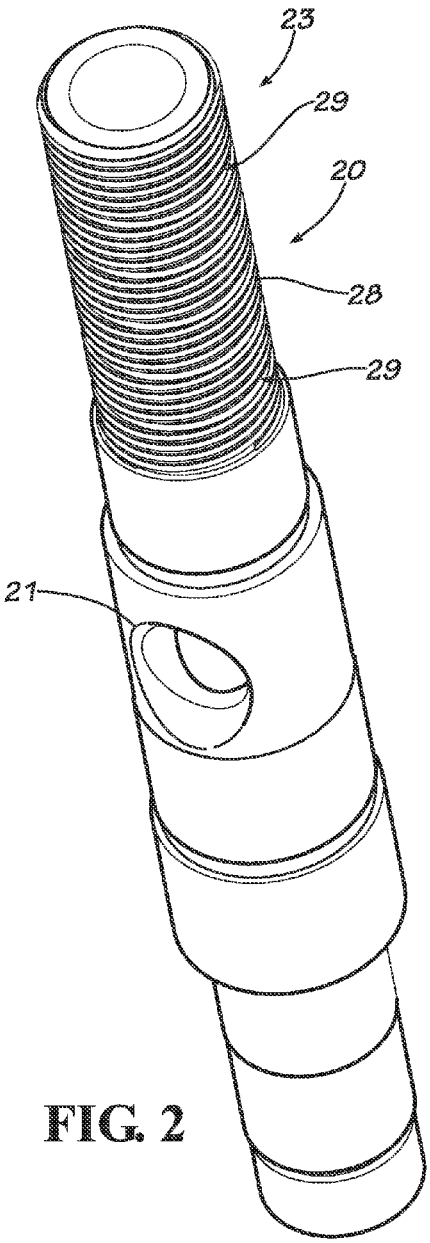
FIG. 2 is a perspective view of a motor shaft of the ceiling fan of FIG. 1.
Figure 3:
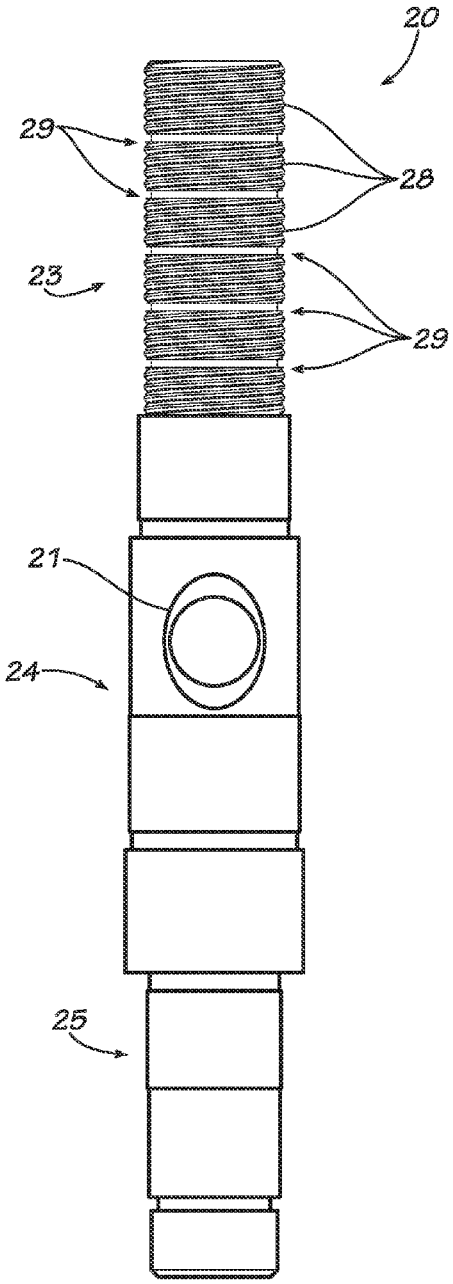
FIG. 3 is a side view of a motor shaft of the ceiling fan of FIG. 1.
Figure 4:
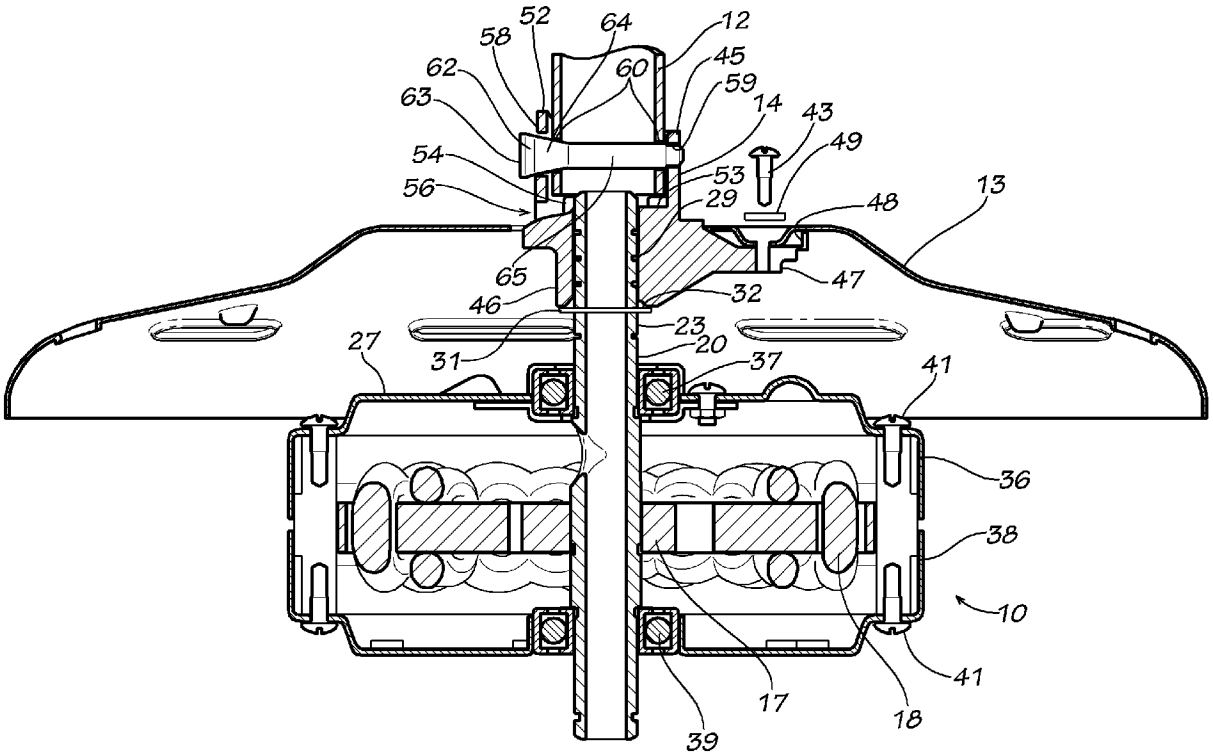
FIG. 4 is a partial cross-sectional view of a portion of the ceiling fan of FIG. 1.
Figure 5:
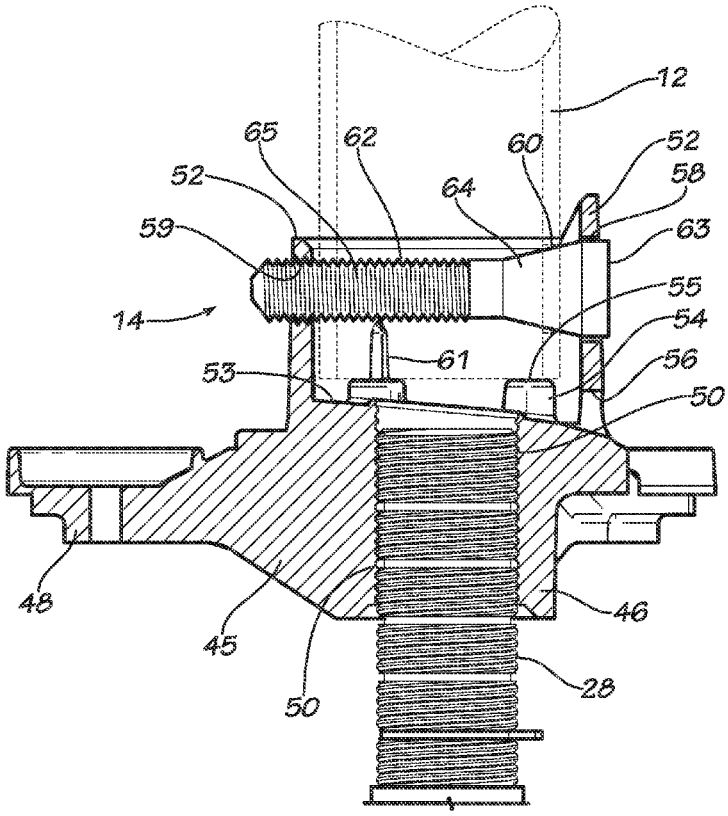
FIG. 5 is a partial cross-sectional view of a portion of a ceiling fan embodying principles of the invention in a preferred form.
Figure 6:
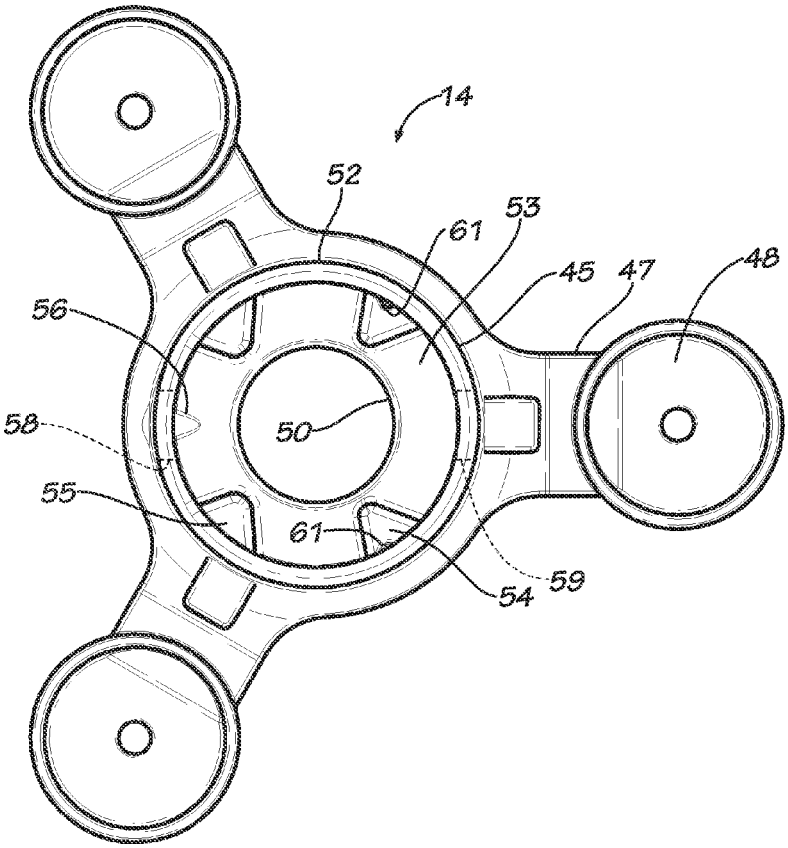
FIG. 6 is a top view of the motor adapter of the ceiling fan of FIG. 1.
Figure 7:
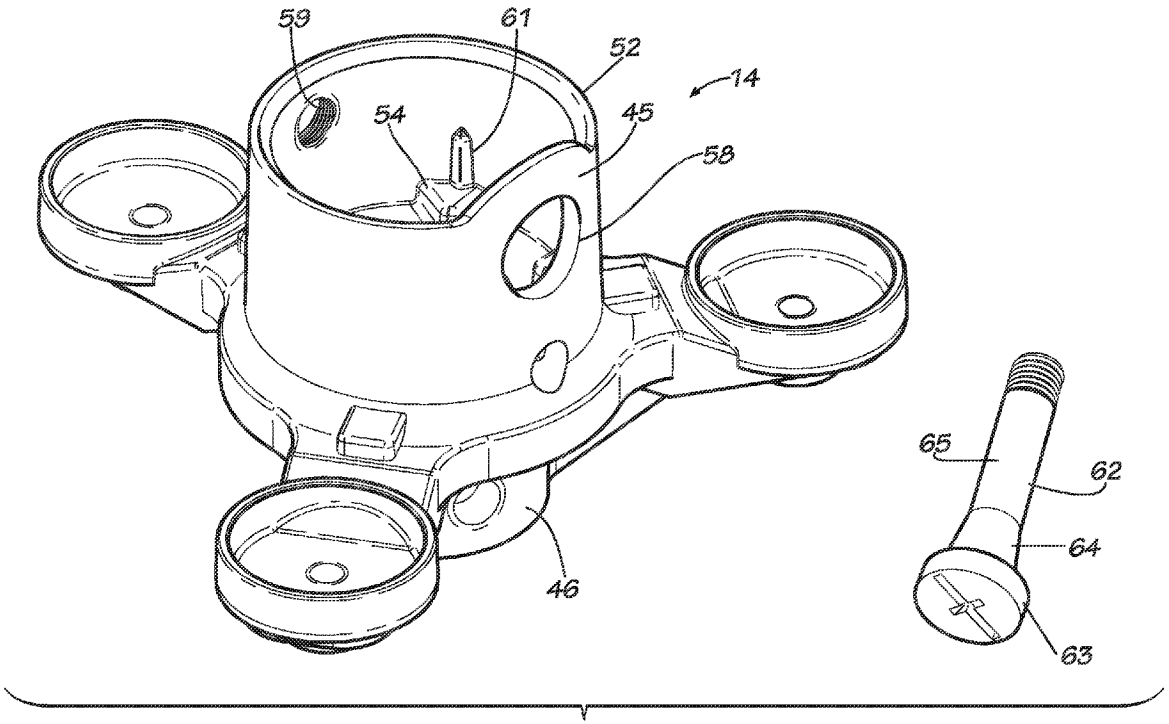
FIG. 7 is a perspective view of the motor adapter of the ceiling fan of FIG. 1.

With reference next to the drawings, there is shown a ceiling fan motor 10 embodying principles of the invention in a preferred form. The ceiling fan motor 10 is shown coupled to a motor adapter 14 having a downrod 12 coupled to an upper end thereof. The motor adapter 14 is also shown coupled to a top portion of an ornamental motor housing 13. The motor housing 13 has an upper portion 15 and lower portion 16 which in combination substantially surround and encase the motor.

The shown ceiling fan motor 10 is of an inside-out design having a centrally mounted stationary stator 17 and a rotor 18 surrounding and rotating about the stationary stator 17. The motor 10 includes a centrally mounted elongated motor shaft 20 which is coupled to the stator 17 in conventional fashion. The motor shaft 20 is tubular and includes a wire passage hole 21 through which the electrical wires of the motor may pass.

The motor shaft 20 has an upper portion 23, a middle portion 24, and a lower portion 25. The middle portion 24 includes the wire passage hole 21 and is coupled to the stator 17 and coupled to the rotor 18 through a motor casing 27, as described in more detail hereinafter. The shaft upper portion 23 extends above the motor casing 27 and has a helical thread 28 and five C-clip channel or spaces 29 which are longitudinally spaced from each other. A C-clip 31 is fitted into one of the five C-clip spaces 29. The C-clip 31 is configured to abut the bottom surface 32 of the motor adapter 14 to limit the downward movement and position of the motor adapter 14 upon the motor shaft 20 during assembly. The motor adapter 14 includes a set screw 33 which may be threaded into abutment with the motor shaft 20 to fix the position of the motor adapter 14 upon the shaft. The shaft lower portion 25 extends downwardly beyond the motor casing 27.

The motor stator 17 is press fitted onto a mid-section of the middle portion 24 of the motor shaft 20. The motor casing 27 includes a top plate 36 having a top bearing 37 which is press fitted onto an upper-section of the middle portion 24 of the motor shaft 20. The motor casing 27 also has a bottom plate 38 having a bottom bearing 39 which is press fitted onto a lower-section of the middle portion 24 of the motor shaft 20. The upper and lower bearings allow the motor casing 19, and therefore the rotor, to rotate about the shaft 20. The motor casing 27 is coupled to the rotor 18 through mounting screws 41 to maintain the position of the rotor 18 relative to the stator 17.

The motor adapter 14 has a central, tubular downrod receiver or hub 45, a tubular motor shaft receiver or hub 46, and three mounting arms 47 extending radially from the downrod receiver 45. Each arm 47 has a recessed well 48 which is configured to receive a resilient spacer or washer 49 and a mounting hole therein configured to receive the motor housing mounting screws 43.

The motor shaft receiver 46 includes internal threads 50 which are configured to mesh or mate with the external threads 28 of the motor shaft.

The downrod receiver 45 is defined by a tubular cylindrical wall 52 extending upwardly from a floor 53. Four triangular shaped seats 54 extend upwardly from the floor 53 and inwardly from the interior surface of the cylindrical wall 52. The four seats 54 have top surfaces 55 which lie in a common plane to abut the bottom end of the downrod. The floor 53 lies at an angle wherein the lowermost portion of the floor is directly adjacent a weep hole 56 extending through the cylindrical wall 52.

The downrod receiver cylindrical wall 52 also includes a first set screw hole 58 which is aligned with an oppositely disposed threaded, second set screw hole 59. The first and second set screw holes 58 and 59 are oriented to be aligned with a pair of downrod set screw holes 60 extending through the downrod 12. The interior surface of the cylindrical wall 52 also includes a pair of elongated ridges or posts 61 which are positioned on either side of the second set screw hole 59. A threaded set screw 62 extends through the first set screw hole 58, through the pair of downrod set screw holes 60, and threaded into the second set screw hole 59. The threaded set screw 62 has a head 63 with a tapered portion 64 and a threaded post or shank 65 opposite the head 63. The tapered portion 64 commences with a diameter size less than the diameter size of the downrod set screw hole 60 and terminates with a diameter size greater than the diameter size of the downrod set screw hole 60. As such, the tapered portion 64 may be considered to be a downrod abutting portion as it abuts the downrod in the area defining the downrod set screw hole closest to the downrod receiver first set screw hole 58. The head 63 is configured to be positioned or seated closely within the first set screw hole 58 to minimize the appearance of the set screw and provide the best fit therebetween.

In use, the ceiling fan downrod 12 is coupled to a mounting plate which is coupled to a junction box fastened within the ceiling of the structure. Once the downrod is secured in place, a ceiling fan installer then raises the motorized portion of the ceiling fan, which already has the motor shaft 20 threaded into the motor adapter motor shaft receiver 46, to a position wherein the lower end of the downrod 12 is positioned or received within the downrod receiver 45 in abutment with the top surfaces 55 of the seats 54. With the downrod set screw holes 60 aligned with the first and second screw holes 58 and 59 of the downrod receiver, the set screw shank 65 is passed through the first set screw hole 58, through the downrod set screw holes 60, and into the threaded second set screw hole 59. The installer then rotates the set screw 62 so that it is threadably drawn into the second set screw hole 59, thereby pulling the set screw tapered portion 64 further through the first set screw hole 58 and the downrod set screw holes 60.

Once the tapered portion 64 of the set screw 62 abuts the downrod (the wall or portion of the downrod about the hole which defines the downrod hole closest to the first set screw hole 58) the continual threaded rotation of the set screw 62 causes the downrod to be forcible moved in a direction towards the second set screw hole 59 and away from the first set screw hole 58. This movement of the downrod continues until the downrod contacts or abuts the downrod receiver opposite the first set screw hole and specifically against the two elongated ridges 61.

The downrod 12 is now supported or connected to the motor adapter at three distinct and separate locations which are preferably 120 degrees from each other (120 degrees between the two ridges 61 and 120 degrees between each ridge 61 and the approximate position of the contact between the set screw and the downrod at the first set screw hole 58). This adapter to downrod contact and more particularly the three point contact or connection aids in preventing the pivoting or rocking of the motor assembly relative to the downrod during operation of the ceiling fan, which was a problem associate with the prior art wherein the motor assembly was supported on a locking pin which acted similarly to an axle.

It should be understood that the orientation terms used herein, such as upwardly and downwardly, are used for illustrative purposes only. It should also be understood that the tapered portion 64 of the set screw may be considered to be part of, or alternatively distinct from, the set screw head 63. Also, it should be understood that as an alternative to the second set screw hole being internally threaded, a threaded nut may be added to mate with the threaded shank. This threaded nut may be either fixed to or separate from the downrod receiver. Likewise, other types of devices or drawings means may be utilized to force the set screw against the downrod, such as a cammed pin, moveable shim, threads within the first set screw hole 58 and mating threads on the set screw head, or other known device for forcing movement.

It thus is seen that a ceiling fan motor adapter is now provided which overcomes problems associated with ceiling fan motors of the prior art. While this invention has been described in detail with particular references to the preferred embodiments thereof, it should be understood that many modifications, additions and deletions, in addition to those expressly recited, may be made thereto without departure from the spirit and scope of the invention.

The invention claimed is:

1. A ceiling fan comprising, a motor having a motor shaft;

a plurality of blades coupled to said motor;

a downrod having a pair of downrod mounting holes, and a motor adapter coupled to said motor shaft and said downrod, said motor adapter having a downrod receiver having a floor and a tubular wall with a first set screw hole therethrough aligned with said downrod pair of downrod mounting holes, a second set screw hole therethrough aligned with said downrod pair of downrod mounting holes, and a weep hole closely adjacent said floor extending through said tubular wall, said second set screw hole having internal threads therein, said tubular wall having an interior surface with two projections extending therefrom, said second set screw hole being positioned between said two projections, said motor adapted also including a set screw having a threaded shank configured to threadably mate with said threaded second set screw hole, a head, and a tapered portion between said shank and said head, said tapered portion being tapered from a size smaller than said downrod mounting holes to a size larger than said downrod mounting holes.

2. The ceiling fan of claim 1 wherein said floor is slanted downwardly towards said weep hole.

3. The ceiling fan of claim 1 wherein said motor adapter includes a plurality of seats extending from said floor and sized to abut said downrod mounted within said motor adapter.

4. The ceiling fan of claim 1 wherein said head is configured to seat within said first mounting hole.

5. A ceiling fan motor adapter designed to be coupled between a motor and a downrod having a downrod hole therethrough, said ceiling fan motor adapter comprising, a tubular downrod receiver having a floor and a weep hole closely adjacent said floor extending through said tubular wall, and a mutually aligned first set screw hole and second set screw hole, said second set screw hole having internal threads, and a set screw having a threaded shank portion configured to threadably mate with said threaded second set screw hole and a tapered head portion extending from said shank portion, said tapered head portion configured to pass into and abut said downrod about said first set screw hole for movement of said downrod towards said second set screw hole through threaded, rotational movement of said set screw, whereby the set screw is threaded into the second set screw hole to force the downrod into contact with the interior of the tubular downrod receiver, and wherein the set screw tapered head portion contacts the downrod opposite the contact between downrod and the interior of the tubular downrod receiver.

6. The ceiling fan motor adapter of claim 5 wherein said tubular downrod receiver includes at least two projections, each projection being positioned on opposite sides of said second set screw hole.

7. The ceiling fan motor adapter of claim 6 wherein said tubular downrod receiver has an interior surface and wherein said two projections extend from said interior surface.

8. The ceiling fan motor adapter of claim 7 wherein said two projections are elongated, generally vertical ridges.

9. The ceiling fan motor adapter of claim 5 wherein said floor is slanted downwardly towards said weep hole.

10. The ceiling fan motor adapter of claim 5 wherein said motor adapter also includes a plurality of seats extending from said floor and sized to abut said downrod mounted within said motor adapter.

11. The ceiling fan motor adapter of claim 5 wherein said head is configured to seat within said first set screw hole.

12. A ceiling fan motor adapter comprising, a motor shaft receiver configured to receive a motor shaft of an electric motor;

a plurality of motor housing mounting arms configured to be coupled to a motor housing surrounding the electric motor;

a downrod receiver having a wall configured to receive a downrod having a lower end with a set screw passageway therethrough, said downrod receiver having a first set screw hole and a second set screw hole oppositely disposed from said first set screw hole, said downrod receiver also having a floor and a weep hole closely adjacent said floor extending through said wall, and a set screw having a shank configured to pass through the downrod and through said second set screw hole, a downrod abutting end configured to abut the received downrod adjacent the downrod set screw passageway, and drawing means for drawing the downrod abutting end towards said second set screw hole and contact with the received down rod.

13. The ceiling fan motor adapter of claim 12 wherein said drawing means comprises external threads upon said shank and mating internal threads coupled to said downrod receiver wall.

14. The ceiling fan motor adapter of claim 13 wherein said mating internal threads are positioned within said second set screw hole.

15. The ceiling fan motor adapter of claim 12 wherein said downrod abutting end has a tapered portion commencing at first end having a diameter size less than that of said first set screw hole and terminating with at a second end having a diameter size greater than that of said first set screw hole.

16. The ceiling fan motor adapter of claim 12 wherein said downrod receiver includes at least two projections, each projection being positioned on opposite sides of said second set screw hole.

17. The ceiling fan motor adapter of claim 16 wherein said downrod receiver has an interior surface and wherein said two projections extend from said interior surface.

18. The ceiling fan motor adapter of claim 16 wherein said two projections are elongated, generally vertical ridges.

19. The ceiling fan motor adapter of claim 12 wherein said floor is slanted downwardly towards said weep hole.

20. The ceiling fan motor adapter of claim 12 wherein said motor adapter also includes a plurality of seats extending from said floor and sized to abut the downrod.

* * * * *